US012012815B2

(12) United States Patent
Gleason

(10) Patent No.: US 12,012,815 B2
(45) Date of Patent: Jun. 18, 2024

(54) SETTING TOOL

(71) Applicant: DBK Industries, LLC, Crowley, TX (US)

(72) Inventor: Brian M. Gleason, Crowley, TX (US)

(73) Assignee: DBK Industries, LLC, Crowley, TX (US)

( * ) Notice: Subject to any disclaimer, the term of this patent is extended or adjusted under 35 U.S.C. 154(b) by 0 days.

(21) Appl. No.: 17/512,513

(22) Filed: Oct. 27, 2021

(65) Prior Publication Data

US 2022/0127919 A1 Apr. 28, 2022

Related U.S. Application Data

(60) Provisional application No. 63/106,700, filed on Oct. 28, 2020.

(51) Int. Cl.

| | |
|---|---|
| ***E21B 23/04*** | (2006.01) |
| ***E21B 23/06*** | (2006.01) |
| *E21B 33/129* | (2006.01) |

(52) U.S. Cl.

CPC ..... *E21B 23/065* (2013.01); *E21B 23/0412* (2020.05); *E21B 23/042* (2020.05); *E21B 33/1292* (2013.01)

(58) Field of Classification Search

None

See application file for complete search history.

(56) References Cited

U.S. PATENT DOCUMENTS 2,618,343 A 11/1952 Conrad
2,637,402 A 5/1953 Baker et al.
(Continued)

FOREIGN PATENT DOCUMENTS

WO WO-2019/165286 A1 8/2019

OTHER PUBLICATIONS

Co-pending U.S. Appl. No. 17/391,205, filed Aug. 2, 2021, entitled "Combination Downhole Assembly", inventors Martin P. Coronado and Brian M. Gleason.

Defendant's Disclosure of Invalidity Contentions, *Diamondback Industries, Inc.* v. *Kingdom Downhole Tools, LLC, et al.*, Civil Action No. 4:18-cv-00902-A, Oct. 25, 2019, 62 pages.

(Continued)

*Primary Examiner* — Kipp C Wallace

(74) *Attorney, Agent, or Firm* — Foley & Lardner LLP; John J. May

(57) ABSTRACT

A setting tool includes a barrel piston that is configured to couple to a setting sleeve and defines a working surface and a vent port. An upper mandrel is disposed within the barrel piston and defines a power charge chamber that is configured to receive a power charge and includes an upper threaded portion, a lower internal thread, and a plurality of axial discharge ports disposed circumferentially around the lower internal thread. The plurality of axial discharge ports are in fluid communication at one end with the power charge chamber and at the other end with the working surface of the barrel piston. A lower mandrel has an upper end and a lower end, with the upper end in threaded engagement with the lower internal thread of the upper mandrel, and the lower end configured to couple to a frac plug. The power charge chamber includes an upper chamber and a lower chamber, with the lower chamber shaped to open to be in fluid communication with each of the plurality of axial discharge ports. The barrel piston is configured for axial displacement with respect to the upper mandrel to position the vent port in fluid communication with the power charge chamber.

19 Claims, 7 Drawing Sheets

(56) References Cited

U.S. PATENT DOCUMENTS

| | | | | |
|---|---|---|---|---|
| 2,713,907 | A | 7/1955 | Kline et al. | |
| 2,713,910 | A | 7/1955 | Baker et al. | |
| 2,799,343 | A | 7/1957 | Conrad | |
| 2,807,325 | A | 9/1957 | Webb | |
| 2,978,028 | A | 4/1961 | Webb | |
| 3,024,843 | A | 3/1962 | Hanes | |
| 3,029,872 | A | 4/1962 | Hanes | |
| 3,029,873 | A * | 4/1962 | Vaughan | E21B 23/065 166/212 |
| 3,055,430 | A | 9/1962 | Campbell | |
| 3,062,295 | A | 11/1962 | Hanes | |
| 3,091,293 | A | 5/1963 | Fry | |
| 3,094,166 | A * | 6/1963 | McCullough | E21B 23/065 166/123 |
| 3,125,162 | A | 3/1964 | Briggs et al. | |
| 3,138,207 | A | 6/1964 | Peppers | |
| 3,160,209 | A | 12/1964 | Bonner | |
| 3,186,485 | A | 6/1965 | Owen | |
| 3,244,232 | A | 4/1966 | Myers | |
| 3,255,822 | A | 6/1966 | Conrad | |
| 3,303,884 | A | 2/1967 | Medford | |
| 4,311,195 | A | 1/1982 | Mullins, II | |
| 5,024,270 | A | 6/1991 | Bostick | |
| 5,203,414 | A | 4/1993 | Hromas et al. | |
| 5,316,087 | A | 5/1994 | Manke et al. | |
| 6,702,009 | B1 | 3/2004 | Drury et al. | |
| 6,874,545 | B1 | 4/2005 | Larimer et al. | |
| 7,017,672 | B2 | 3/2006 | Owen, Sr. | |
| 7,036,602 | B2 | 5/2006 | Turley et al. | |
| 7,077,212 | B2 | 7/2006 | Roesner et al. | |
| 7,303,020 | B2 | 12/2007 | Bishop et al. | |
| 8,132,627 | B2 | 3/2012 | Braddick | |
| 8,887,818 | B1 | 11/2014 | Carr et al. | |
| 9,453,382 | B2 | 9/2016 | Carr et al. | |
| 9,810,035 | B1 | 11/2017 | Carr et al. | |
| 10,107,054 | B2 | 10/2018 | Drury et al. | |
| 11,066,886 | B2 | 7/2021 | Mickey | |
| 2004/0055755 | A1 | 3/2004 | Roesner et al. | |
| 2004/0216868 | A1 | 11/2004 | Owen, Sr. | |
| 2007/0107913 | A1 | 5/2007 | Arnold et al. | |
| 2013/0140041 | A1 | 6/2013 | Allen et al. | |
| 2013/0299160 | A1 | 11/2013 | Lott | |
| 2015/0285019 | A1 | 10/2015 | Wood et al. | |
| 2015/0308236 | A1 | 10/2015 | Lagrange et al. | |
| 2016/0115753 | A1 | 4/2016 | Frazier et al. | |
| 2017/0166161 | A1 | 6/2017 | Englbrecht et al. | |
| 2018/0080298 | A1 | 3/2018 | Covalt et al. | |
| 2019/0277103 | A1 | 9/2019 | Wells et al. | |
| 2020/0018132 | A1* | 1/2020 | Ham | E21B 23/04 |
| 2020/0095838 | A1* | 3/2020 | Baker | E21B 23/065 |
| 2020/0115978 | A1 | 4/2020 | Mickey et al. | |
| 2020/0115979 | A1* | 4/2020 | Mickey | E21B 23/065 |
| 2020/0248516 | A1* | 8/2020 | Knight | E21B 33/128 |
| 2020/0362652 | A1* | 11/2020 | Eitschberger | E21B 23/06 |
| 2022/0034181 | A1* | 2/2022 | Coronado | E21B 23/0414 |
| 2022/0081985 | A1* | 3/2022 | Pendse | E21B 23/14 |

OTHER PUBLICATIONS

Product Description Page: Schlumberger—Model E Hydraulic Setting Tool, Used to run and set packers, bridge plugs, and cement retainers on a workstring, production tubing, or coiled tubing; slb.com/packers, Copyright 2014, 1 page.

Foreign Search Report on PCT PCT/US2021/056895 dated Feb. 9, 2022.

International Search Report and Written Opinion on PCT PCT/US2021/056895 dated Feb. 9, 2022.

* cited by examiner

SETTING TOOL

PRIORITY CLAIM

This application claims priority to U.S. Provisional Application No. 63/106,700, filed on Oct. 28, 2020, the disclosure of which is incorporated herein by reference in its entirety.

CROSS-REFERENCE TO RELATED APPLICATIONS

This application is subject matter related to U.S. patent application Ser. No. 17/391,205 entitled "Combination Downhole Assembly" filed on Aug. 2, 2021 and naming Brian Gleason as co-inventor, which claims priority to U.S. Provisional Application for Patent No. 63/071,709 filed on Aug. 28, 2020.

BACKGROUND

The present invention relates generally to the field of downhole tools used in operations associated with releasing and collecting oil and natural gas from a subterranean formation containing hydrocarbons. It is often necessary to seal off or otherwise isolate a section of a casing formed to extract hydrocarbons from a subterranean formation. A casing may be sealed by running a frac plug downhole to the desired location in the casing. Once at the desired location, the frac plug is then set, which creates the desired seal. A frac plug may be set using a setting tool. Setting the frac plug also breaks a connection between the frac plug and the setting tool to allow the setting tool to be removed to allow subsequent operations in the well. Certain setting tools may also be reconfigured for a subsequent setting operation.

Typically, a setting tool strokes with a sudden and relatively uncontrolled stroke of a barrel piston. A setting tool with a more linear displacement of the barrel piston with respect to time may be an improvement over conventional setting tools. In addition, a setting tool in which the stroke is better controlled and accomplished with a smaller power charge may provide an improvement over conventional setting tools.

SUMMARY

One embodiment of the disclosed setting tool includes a barrel piston that is configured to couple to a setting sleeve and defines a working surface and a vent port. An upper mandrel is disposed within the barrel piston and defines a power charge chamber that is configured to receive a power charge and includes an upper threaded portion, a lower internal thread, and a plurality of axial discharge ports disposed circumferentially around the lower internal thread. The plurality of axial discharge ports are in fluid communication at one end with the power charge chamber and at the other end with the working surface of the barrel piston. A lower mandrel has an upper end and a lower end, with the upper end in threaded engagement with the lower internal thread of the upper mandrel, and the lower end configured to couple to a frac plug or other downhole isolation device. The power charge chamber includes an upper chamber and a lower chamber, with the lower chamber shaped to open to be in fluid communication with each of the plurality of axial discharge ports. The barrel piston is configured for axial displacement with respect to the upper mandrel to position the vent port in fluid communication with the power charge chamber.

According to the teachings of the present disclosure, a static volume is provided to allow gas to expand and heat in a chamber of an upper mandrel before any displacement of the barrel piston of the setting tool occurs. In addition, more surface area of the barrel piston that is positioned orthogonal to an axis of the tool and to the axes of axial discharge ports better distributes the force of the expanding gas. Thus, the efficiency of the setting tool may be increased because less combustible material is required to stroke the setting tool An additional technical advantage includes a setting tool with a more controllable axial displacement of the barrel piston. For example, the displacement of the barrel piston may occur over a longer period than conventional setting tools and the relationship of displacement of the barrel piston with respect to time may be more linear.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1A:
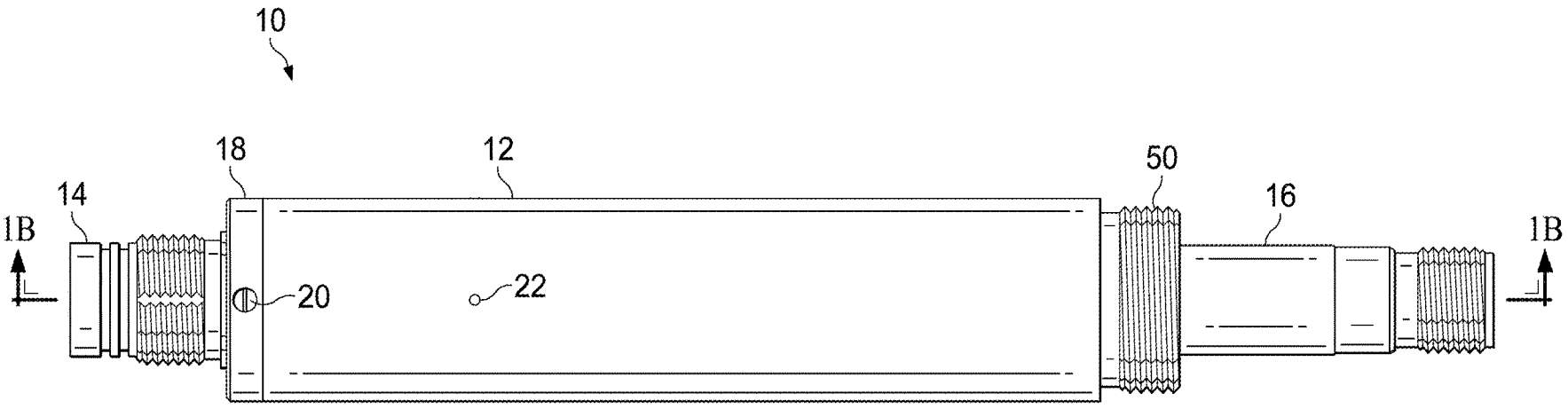
FIG. 1A is an elevation view of a setting tool according to the teachings of the present disclosure.
Figure 1B:
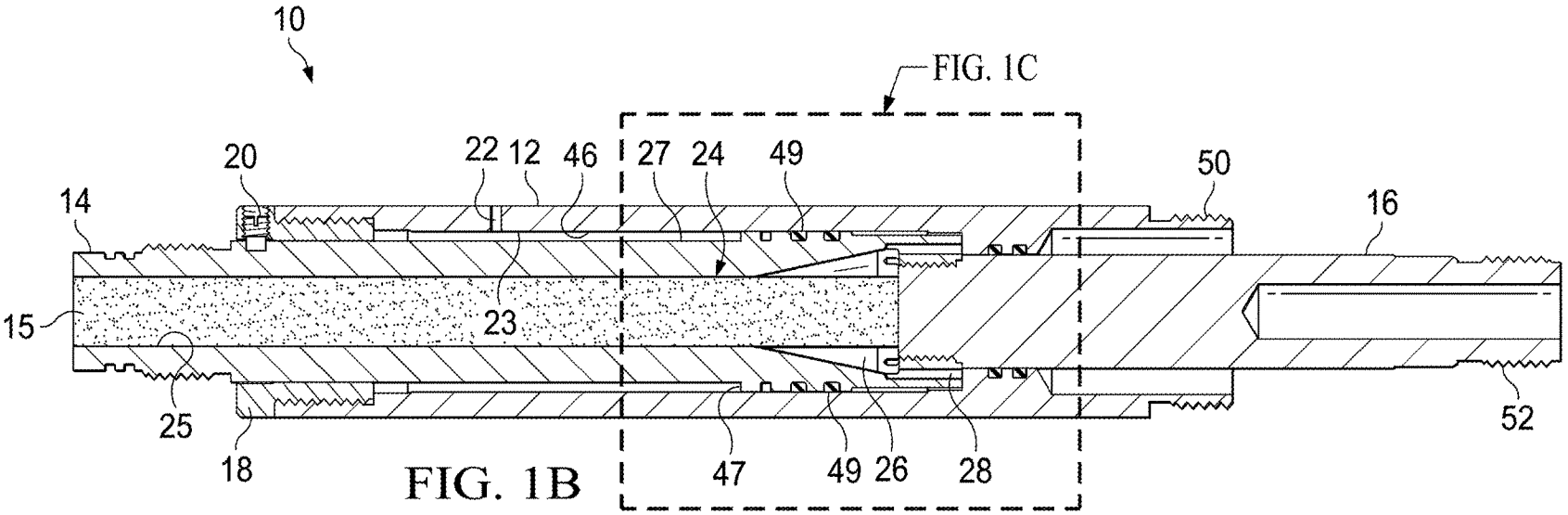
FIG. 1B is a cross-section of the setting tool shown in FIG. 1A.

Referring to FIGS. 1A and 1B, which show an elevation view and a cross-section respectively of a setting tool 10 according to the teachings of the present disclosure. The setting tool 10 may be used in connection with a downhole isolation device, such as a frac plug, bridge plug, tubing packer, and the like. Downhole isolation devices may be generally referred to as frac plugs. The setting tool 10 may be deployed downhole on a wireline. The lower end of the setting tool 10 may be coupled to a frac plug via an adapter or may be directly coupled to the frac plug. At the upper end, the setting tool may be coupled to other downhole tools, particularly when the setting tool 10 is used in multistage hydraulic fracturing operations.

The setting tool 10 includes a barrel piston 12, which is a cylindrical sleeve that is axially displaceable with respect to an upper mandrel 14 and a lower mandrel 16. The barrel piston 12 is coupled to the upper mandrel 14 by a retainer cap 18 that is threaded to the barrel piston 12. A shear screw 20 is received through the retainer cap 18 and into the upper mandrel 14, which thereby couples the barrel piston 12 to the upper mandrel 14. The shear screw 20 is designed to shear and release the barrel piston 12 for axial movement with respect to the upper mandrel 14 and the lower mandrel 16. The setting tool 10 is operated by igniting a power charge 15. Ignition of the power charge 15 causes gasses to expand, which creates and elevated pressure that pressurizes the setting tool 10 and drives the axial displacement of the barrel piston 12.

The barrel piston 12 will move downwardly with respect to the upper mandrel 14 when the internal pressure created by the expanding gasses causes the barrel piston 12 to shear and fracture the shear screw 20. The barrel piston is then 12 released for axial movement with respect to the upper mandrel 14 and the lower mandrel 16. The downward motion of the barrel together with the tensile force applied to a mandrel of a frac plug by the lower mandrel 16 causes the frac plug to engage the casing. The tensile force applied by the lower mandrel 16 overcomes a shear strength of a second shear component coupled to the mandrel of the frac plug (not shown), and the setting tool 10 is released from the set frac plug.

The displacement of the barrel piston 12 is referred to as a stroke. A full stroke of the setting tool 10 positions a vent port 22 beyond a sealing section to allow the expanded gas that has pressurized the setting tool 10 to vent to the ambient environment and depressurize the setting tool 10. The setting tool 10 can then be withdrawn from the wellbore. In certain embodiments, the setting tool 10 may be redressed for subsequent use.

With reference to FIG. 1B, the lower mandrel 16 is threaded to the upper mandrel 14. The barrel piston 12 houses the upper mandrel 14. According to an embodiment, there is a clearance between a portion of an inner cylindrical surface 23 of the barrel piston 12 and a portion of an outer cylindrical surface 27 of the upper mandrel 14. This clearance allows a shoulder stop 47 to extend from the upper mandrel 14. The shoulder stop 47 functions to stop the axial displacement of the barrel piston 12 and terminate the stroke. The upper mandrel 14 includes a power charge chamber 24 that is configured to hold the power charge 15. The power charge chamber 24 includes a cylindrical bore with a generally uniform diameter to hold a corresponding cylindrical power charge 15.

The power charge chamber 24 includes an upper chamber 25 that merges into a lower chamber 26 that is disposed below the upper chamber 25. The lower chamber 26 is an open volume created by increasing the diameter of the upper chamber 25. The pressure accumulation function of the power charge chamber 24 is explained in more detail below. In the illustrated embodiment, the lower chamber 26 may be generally frustoconical—tapering from a smaller diameter to a larger diameter in a direction away from the retainer cap 18. According to an embodiment, the taper angle is in a range of 10° to 15°, for example 12°. The lower chamber 26 is partially closed by the upper end of the lower mandrel 16. The lower mandrel 16 couples the mandrel of the frac plug to the setting tool 10, with or without an adaptor.

Figure 1C:
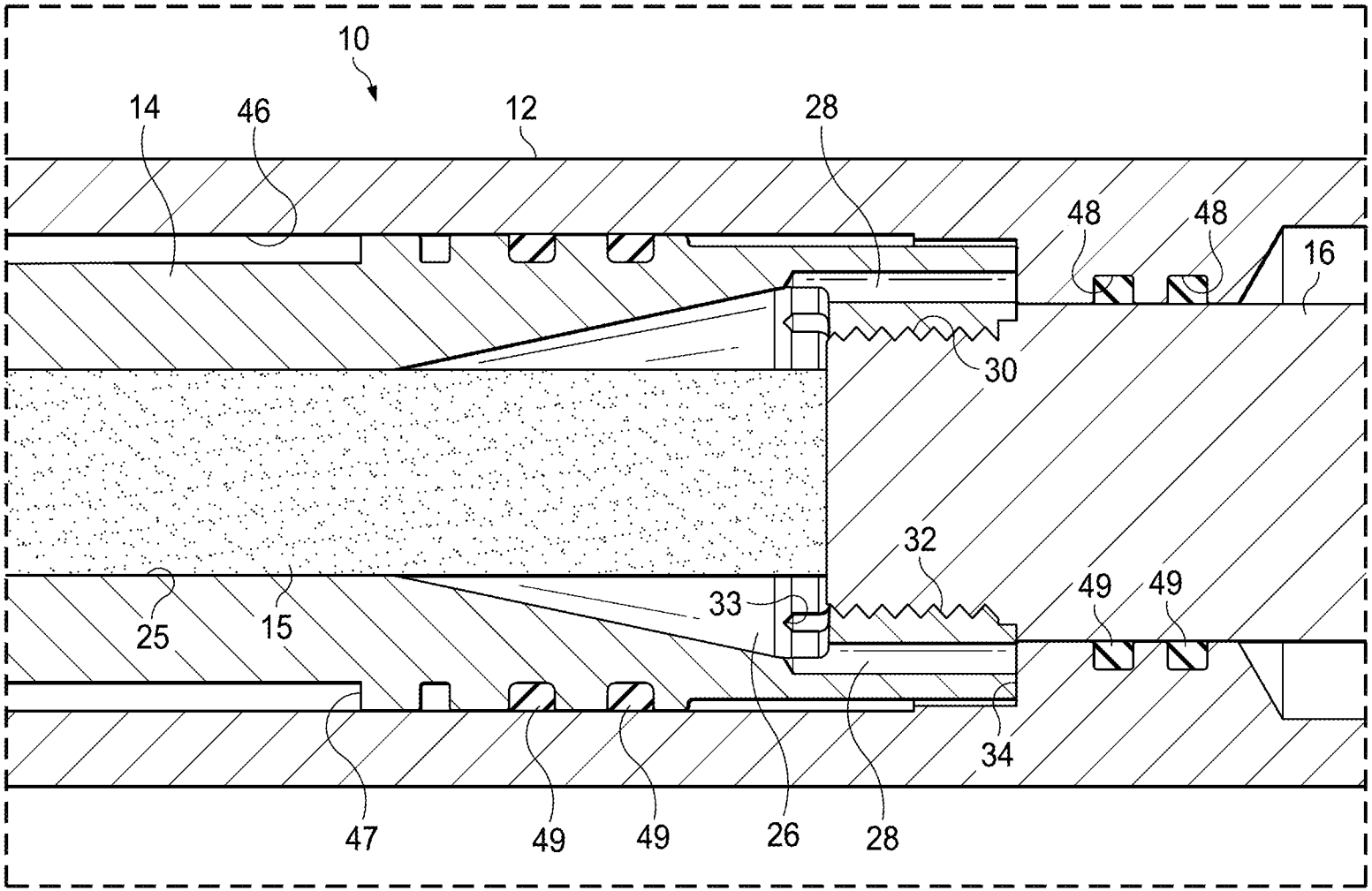
FIG. 1C is a detail view of the cross-section of the setting tool shown in FIG. 1B.

With reference to FIG. 1C, which is a detail view of a junction of the barrel piston 12, the upper mandrel 14, and the lower mandrel 16. An upper portion of the lower mandrel 16 includes a male threaded portion 30 that engages a female threaded portion 32 of the upper mandrel 14. According to one embodiment, the female threaded portion 32 of the upper mandrel 14 is a right-handed thread, but a left-handed thread is also contemplated by this disclosure.

Axial discharge ports 28 are formed in the upper mandrel 14. Each axial discharge port 28 is a bore with an axis that is parallel to the longitudinal axis of the setting tool 10. Each of the axial discharge ports 28 are in fluid communication with the lower chamber 26. Each of the axial discharge ports 28 are semi-blind in that about half to two-thirds of the diameter of each port is open to the lower chamber 26, and the other one-third to one-half is blind and closed to the lower chamber 26. The portions of the axial discharge ports 28 disposed closer to the centerline of the upper mandrel 14 are open, and the portions further from the centerline are closed. The semi-blind holes allow a thicker and sturdier annular wall of the upper mandrel 14 to withstand the increased internal pressure created by the expanding gasses originating from the power charge 15. The thinner portions of the annular wall are located at each axial discharge port, but the majority of the annular wall has a thickness from the outer surface of the upper mandrel 14 to the interior female threaded portion 32. The floors 33 of six of the axial discharge ports 28 are visible in the cross-sections of FIGS. 1B and 1C. The partially open floor 33 of the axial discharge ports 28 allow the axial discharge ports 28 to be in fluid communication with the lower chamber 26.

The upper mandrel 14 may include any suitable number of axial discharge ports 28. According to one embodiment, a setting tool 10 that may be employed in situations in which a Baker 20 setting tool might be used may include ten axial discharge ports 28. In an alternate embodiment, a setting tool 10 that may be employed in situations in which a Baker 10 setting tool might be used may include six axial discharge ports 28. The present disclosure contemplates an upper mandrel 14 that includes 2, 3, 4, 5, 6, 7, 8, 9, 10, 11, 12, or more axial discharge ports 28 that are evenly spaced circumferentially around the female threaded portion 32. An upper mandrel 14 with ten axial discharge ports 28 circumferentially evenly spaced apart is shown in FIG. 1B. An upper mandrel 14 with six axial discharge ports 28 circumferentially spaced apart evenly is shown in FIGS. 1C and 2B. It may be preferable to have 6-12 axial discharge ports 28.

The lower chamber 26 provides an open volume for accumulation of the expanding gas pressure within the upper mandrel 14. The volume in the upper mandrel 14 is static in that it does not vary with displacement of the barrel piston 12. Moreover, the open volume is not reduced by the presence of the lower mandrel 16. Thus, gas pressure from the power charge 15 may accumulate in the lower chamber 26 before it substantially acts on the barrel piston 12. In conventional setting tools, gas pressure accumulates in an annular region around a mandrel of the setting tool. This annular region is typically a relatively small volume and there is no separation between the annular region and the portion of the barrel piston acted on by the expanding gasses. In conventional setting tools, there is no open pressure accumulation region within an upper mandrel that houses the power charge whose volume is independent of the displacement of the barrel piston. An example of a setting tool with an annular region disposed within the barrel piston and around a lower mandrel is shown and described in U.S. Pat. No. 9,810,035 to Carr et al. and entitled Disposable Setting Tool, which is incorporated herein by reference.

The ignition of the power charge 15 causes gasses to expand and accumulation of a gas pressure. The axial discharge ports 28 direct the expanding gas from the lower chamber 26 to act on the barrel piston 12 and cause it to be axially displaced. More specifically, the circular openings of the axial discharge ports 28 that are disposed opposite the port floor 33 are disposed proximate a working surface 34 of the barrel piston 12. The working surface 34 is orthogonal to an axis of each axial discharge port 28 and to the axis of the setting tool 10. This configuration allows the pressure created by the expanding gas to act on the working surface 34 in the direction of motion of the barrel piston 12. Thus, the setting tool 10 is stroked with increased efficiency (i.e. less force created by the power charge is required to generate the stroke) because the pressure is directed by the axial discharge ports 28 in the direction of motion of the barrel piston 12. The surface area of the working surface 34 of the barrel piston 12 is increased to maximize the surface area that can be acted on by the expanding gasses. According to certain embodiments, the surface area of the working surface 34 may be determined based on the dimensions of the barrel piston inner diameter 67 and the lower mandrel outer diameter 64 shown in FIGS. 4 and 5 and listed in the chart below.

Also, the area of the opening of each of the discharge ports 28 and the number of discharge ports 28 distribute the force of the expanding gas pressure over an area equal to the area of each opening of the axial discharge ports 28 times the number of axial discharge ports 28. In this manner, less force from the expanding gas is required to shear the shear screw 20, stroke the barrel piston 12, and set the frac plug. According to alternate embodiments, an increased number of axial discharge ports 28 and/or an increase in size of the area of the opening of each axial discharge port 28 may increase the efficiency of the setting tool 10 in shearing the shear screw 20 and setting the frac plug. That is, the expanding gas will accumulate a pressure to shear the shear screw 20 and set the frac plug at a lower gas pressure than conventional setting tools (i.e. the setting tool 10 will actuate and set the frac plug sooner after the power charge is ignited).

According to one embodiment, the power charge 15 may be smaller and include less combustible material than conventional power charges used with a tool of similar size to the setting tool 10. For example, the setting tool 10 may be used in operations in which a Baker 20 would be appropriate. A 460 gram power charge might be used to operate the Baker 20 setting tool to set a frac plug. Whereas, according to an embodiment of the present disclosure, the setting tool 10 may employ a 265 gram power charge in operation to set a frac plug.

Figure 2A:
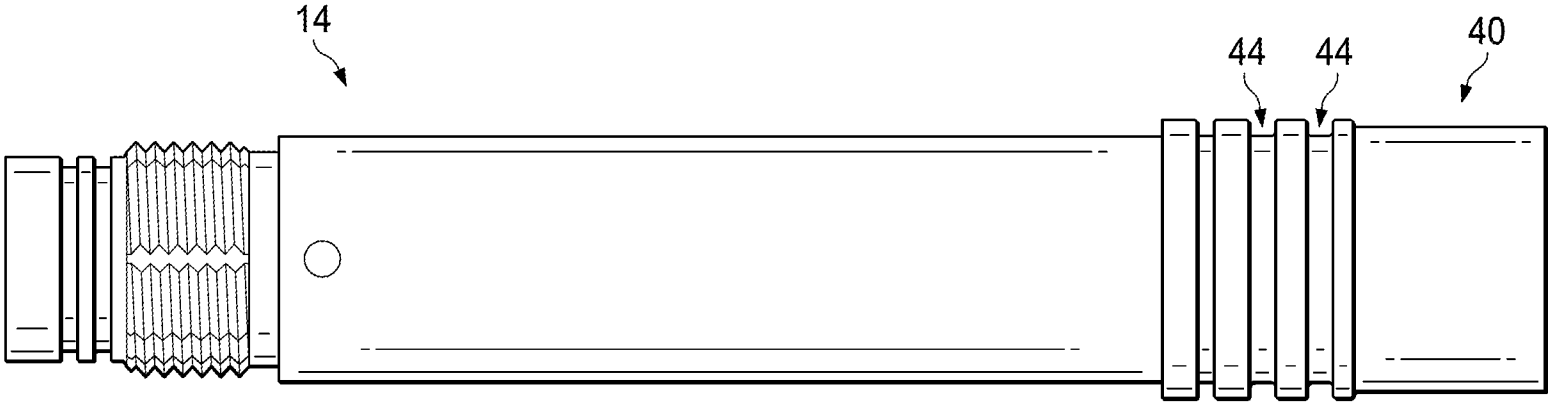
FIG. 2A is an elevation view of an upper mandrel of a setting tool according to an embodiment of the present disclosure.
Figure 2B:
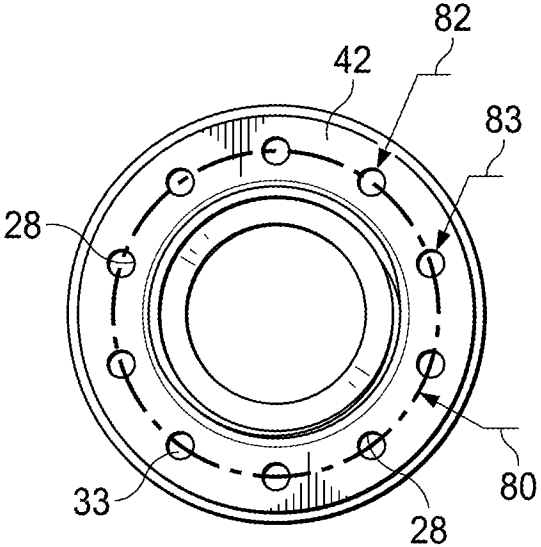
FIG. 2B is an end view of the upper mandrel shown in FIG. 2A.
Figure 2C:
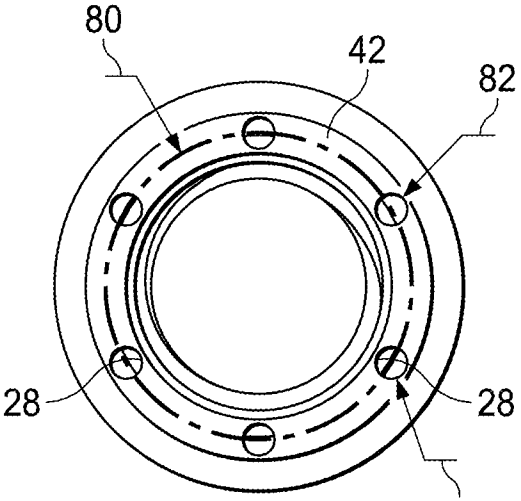
FIG. 2C is an end view of an alternate embodiment of an upper mandrel according to the teachings of the present disclosure.

Reference is made to FIGS. 2A and 2B, which are an elevation view and a side, end view respectively of the upper mandrel 14. A lower annular portion 40 of the upper mandrel 14 includes a bottom face 42, the female threaded portion 32, the lower chamber 26 (shown in FIGS. 1B and 1C), and the plurality of axial discharge ports 28. The lower annular portion 40 receives the male threaded portion 30 of the lower mandrel 16, and the lower mandrel 16 substantially closes the lower chamber 26 except for the fluid passages created by the axial discharge ports 28. FIG. 2B shows ten semi-blind axial ports 28 with the floor 33 of the axial port shown covering approximately half the port 28, with the remaining portion being open to the lower chamber 26. According to an alternate embodiment illustrated in FIG. 2C, a bottom face 42 of an upper mandrel 14 includes six axial discharge ports 28 circumferentially evenly spaced apart from each other. An embodiment of the upper mandrel 14 with six axial discharge ports 28 may be used in substitution for a Baker 10 setting tool. The axial discharge ports 28 are semi-blind in that the floors 33 of the axial discharge ports 28 close a portion of the port 28, for example half of the port 28, and the remainder of the port 28 is open to the lower chamber 26.

An outer surface of the lower annular portion 40 includes a plurality of annular channels 44, for example two annular channels, configured to receive elastomeric O-rings 49. The O-rings 49 create a fluid-tight seal between an inner cylindrical surface 46 of the barrel piston 12 and the upper mandrel 14. Alternatively, the channels 44 housing the O-rings 49 may be formed in the inner cylindrical surface 46 of the barrel piston 12.

According to an embodiment, an upper portion of the barrel piston 12 may include a counter bore to a depth that is approximately even with the vent port 22. The counter bore may provide relief to the O-rings 49 such that they will slide past the vent port 22 during assembly of the upper mandrel 14 with the barrel piston 12. The counter bore may increase the diameter of the inner cylindrical surface 23 approximately 1.7%. According to one embodiment, the nominal bore diameter may be approximately 2.9 inches, and the counter bore diameter may be approximately 2.95 inches. The enlarged diameter of the counter bore surface compresses the O-rings 49 less than the inner cylindrical surface 23 of the barrel piston 12.

Returning to FIGS. 1B and 1C, a lower fluid tight seal is formed between the lower mandrel 16 and the barrel piston 12. According to one embodiment, the barrel piston 12 includes a plurality of lower seal channels 48, for example two lower seal channels 48. The lower seal channels 48 are configured to receive elastomeric O-rings 49 to form a fluid (e.g. gas) tight seal between the lower mandrel 16 and the barrel piston 12. The O-ring seals 49 ensure that the gas pressure is prevented from escaping either upward or downward from the setting tool 10. Thus, the pressure is maintained and can increase and power the axial displacement of the barrel piston 12.

The upper mandrel 14 also includes a shoulder stop 47 extending from an outer cylindrical surface. The shoulder stop 47 is contacted by the retainer cap 18 at the termination of the stroke and ensures that the setting tool 10 remains intact under the high pressures associated with stroking the barrel piston 12 and setting a frac plug. The shoulder stop 47 may act as a crumple zone to dissipate the energy of the barrel piston 12 that remains upon completion of setting the setting tool 10. According to an embodiment, the shoulder stop 47 is positioned with respect to the vent port 22 such that when the retainer cap 18 contacts the shoulder stop 47, the vent port 22 is positioned beyond the annular channels 44 in fluid communication with the power charge chamber 24. In this manner, the vent port 22 is positioned to release the pressure in the setting tool 10 at the termination of the stroke of the barrel piston 12.

According to an alternate embodiment, an impact collar may be positioned axially between the retainer cap 18 and the shoulder stop 47. The impact collar may be a ring of sturdy metal with an inner diameter that closely conforms to the outer diameter of the upper mandrel 14. In this manner, in setting a frac plug, the internal pressures cause the shoulder stop 47 to slam into the impact collar, as opposed to the retainer cap 18. Use of the impact collar may reduce or eliminate any wedging of the shoulder stop 47 underneath the retainer cap 18 that might otherwise occur because the retainer cap is looser fitting with respect to the upper mandrel 14 than the impact collar.

According to one embodiment, the outer cylindrical surface of the upper mandrel 14 may include one or more flutes. The flutes may be formed by removing material from the outer surface of the upper mandrel 14. The flutes may facilitate the axial motion of the barrel piston 12 with respect to the upper mandrel 14 in the event debris or other material is present in the unsealed region between the barrel piston 12 and the upper mandrel 14. Debris or other downhole material may be forced into this unsealed region due to the high hydrostatic or other well pressures, which may be as high as 12,000 psi.

The barrel piston 12 and the lower mandrel 16 are configured to attach to standard adaptors that are readily available at well sites to join the setting tool 10 to a frac plug. For example, a setting sleeve may be threaded to an external thread 50 of the barrel piston 12. A mandrel adaptor may be secured to the lower mandrel 16 using the external thread 52 of the lower mandrel 16. The mandrel adaptor is secured to the mandrel of the frac plug such that a tensile force on the frac plug mandrel opposes the force of the setting sleeve on the slip assembly of the frac plug. An example of adapters that may be secured to the setting tool 10 is described in U.S. Patent Publication No. 2020/0190927 to Mickey et. al., which is incorporated herein by reference. Alternatively, the lower mandrel 16 is configured to be interchanged with a rod that is configured to attach directly to the mandrel of the frac plug, and an adaptor may be omitted. Thus, the setting tool 10 is configured for multiple types of frac plug assemblies depending on the lower mandrel 16 that is attached to the upper mandrel 14. Various different designs of frac plugs and adapters may be used in conjunction with the setting tool of the present disclosure.

A firing head (not shown) is attachable to an upper end of the upper mandrel 14. A seal is created by the firing head to ensure that the gas pressure in the power chamber is directed to power the axial motion of the barrel piston and does not escape from the setting tool 10.

When the setting tool 10 is used in a hydraulic fracturing operation to set a frac plug, the setting sleeve and the frac plug (or the mandrel adaptor and the frac plug) are secured to the setting tool 10 at the surface. A power charge is inserted into the power charge chamber 24. A firing head is then attached to the upper end of the upper mandrel 14. The setting tool 10 is run into the wellbore to the location at which it is desired to deploy the frac plug to isolate the well.

An electrical or other signal is sent to the firing head causing an igniter to ignite the power charge. The ignition of the power charge causes gasses to be released from the power charge and the gas pressure to accumulate in the upper chamber 25, the lower chamber 26, and the axial discharge ports 28. According to an embodiment, gas pressure builds for approximately 4-10 seconds after the ignition of the power charge. At this time, the pressure in the setting tool 10 has increased such that sufficient force is applied to the working surface 34 of the barrel piston 12 to shear the shear screw 20. The shear screw 20 fractures and the barrel piston 12 moves approximately 0.5 inches and pauses. In conventional setting tools, pressure builds to create sufficient force to shear the shear screw, and the full stroke occurs substantially simultaneously with the fracturing of the shear screw, approximately 1-4 seconds after ignition of the power charge.

After a brief pause, the forces created by the expanding gasses are sufficient to fully stroke the barrel piston 12 and set the frac plug. Specifically, the mandrel of the frac plug is held by the lower mandrel 16, and the setting sleeve is driven downward by the barrel piston 12. The setting sleeve directs the slip assembly of the frac plug to anchor to the casing. An elastomeric seal element that is disposed between an upper sleeve and a lower sleeve of the frac plug is compressed between the upper and lower sleeve to create a seal between the frac plug and the well casing. The upper and lower sleeves anchor the frac plug to the well casing through the motion of the setting sleeve.

Figure 3:
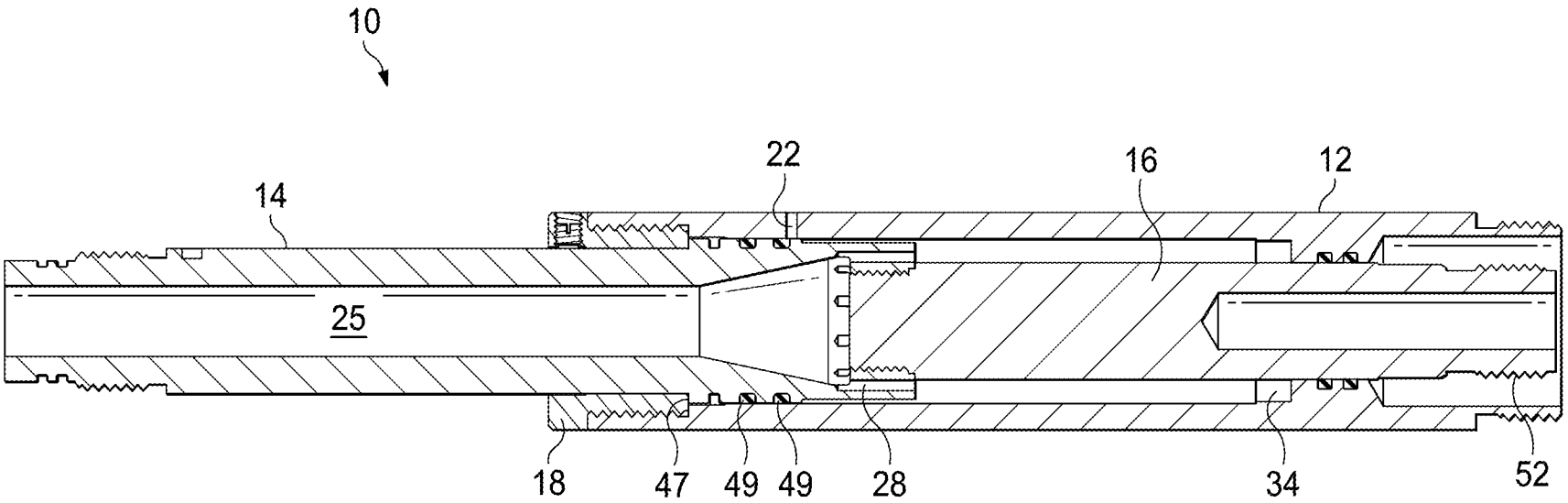
FIG. 3 is a cross section of a setting tool according to an embodiment of the present disclosure where the barrel piston has been stroked.

Finally, the pressure in the setting tool 10 is opposed by the anchored frac plug and the tensile forces on the frac plug due to the lower mandrel 16 shears a shear element connecting the setting tool 10 to the mandrel of the frac plug. This action also causes the vent port 22 to be positioned beyond the seals 49 that are disposed between the upper mandrel 14 and the barrel piston 12 such that the vent port 22 is in fluid communication with the expanding gas. Thus, the expanding gas can be vented out of the setting tool 10 into the ambient environment of the wellbore. FIG. 3 illustrates the setting tool 10 in a stroked configuration. According to some embodiments, the vent port 22 may receive a plug that the gas pressure ejects to allow the internal gas pressure to vent. The setting tool 10 is released from the frac plug and can be removed from the wellbore. The setting tool may be discarded or in certain embodiments, the setting tool 10 may be redressed for subsequent uses.

The setting tool 10 may be formed from any suitable material using any suitable metal forming operation. For example, the setting tool 10 including the barrel piston 12, the upper mandrel 14, and the lower mandrel 16 may be machined out of 1045 steel bar stock. According to an alternate embodiment, a stronger steel may be used for a setting tool 10 that may withstand multiple uses.

Figure 4:
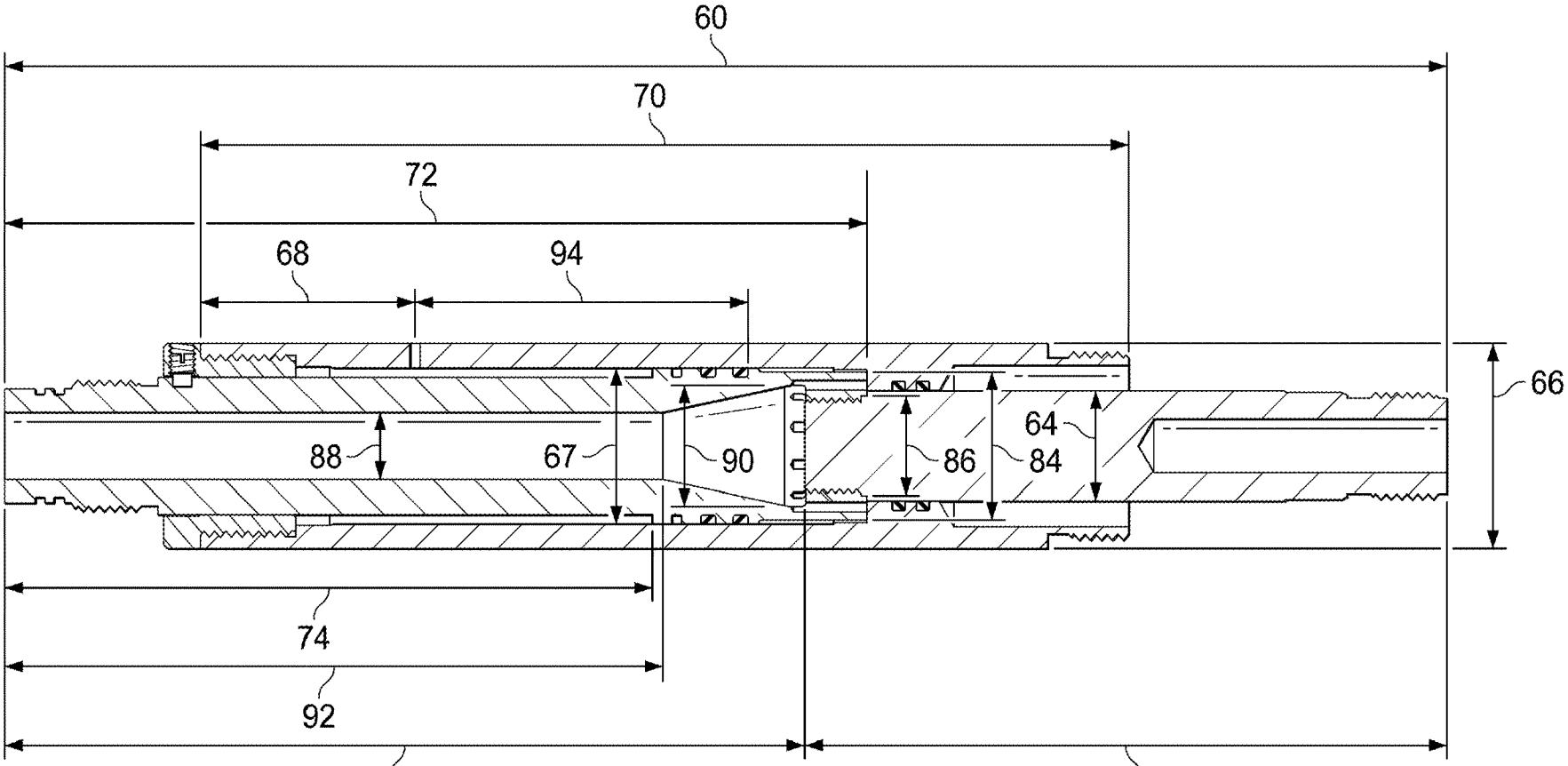
FIG. 4 is a cross section of a setting tool according to an embodiment of the present disclosure indicating certain dimensions.
Figure 5:
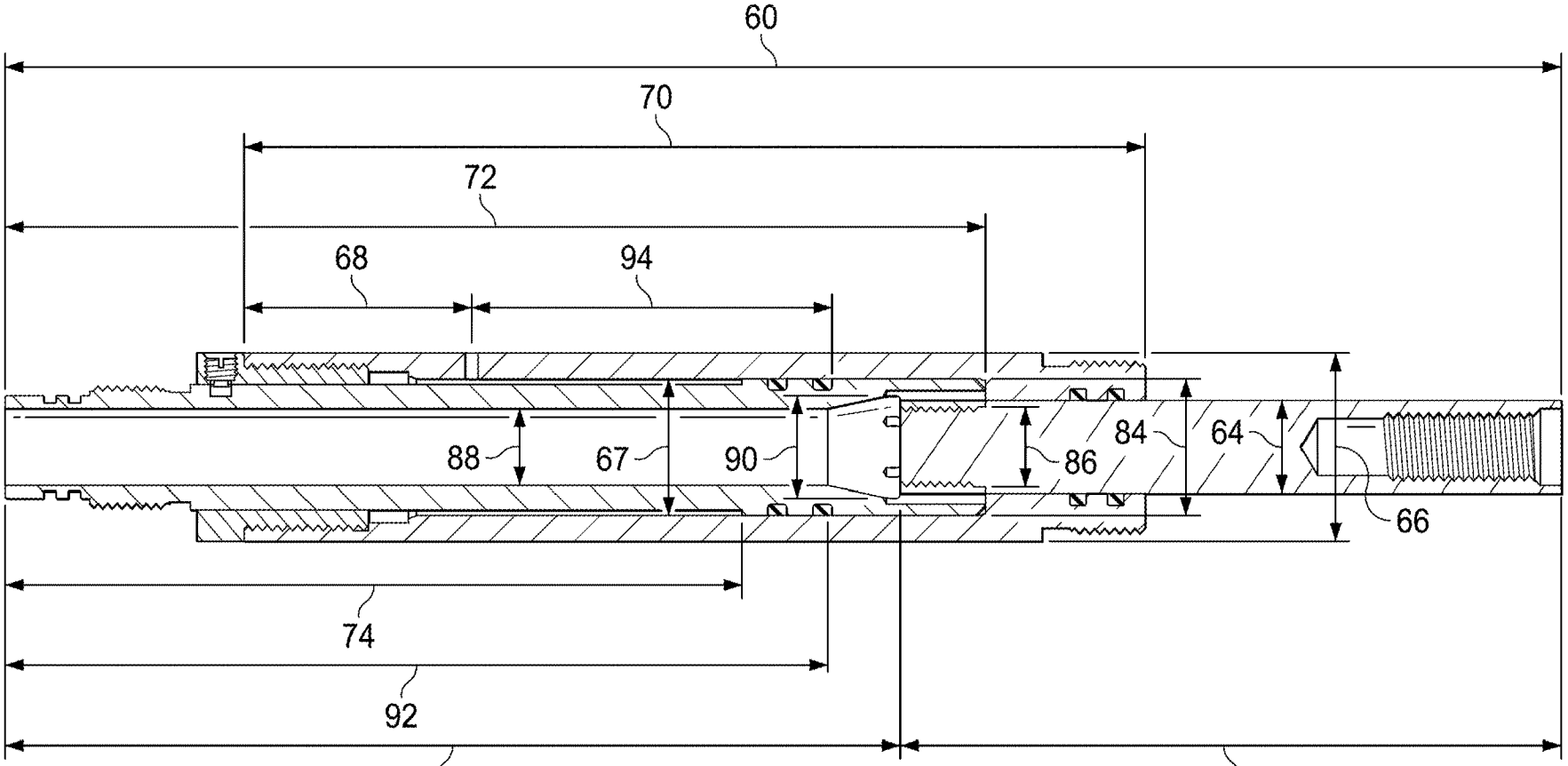
FIG. 5 is a cross section of a setting tool according to an alternate embodiment of the present disclosure indicating certain dimensions.

FIG. 4 is a cross section of an embodiment of a setting tool according to the teachings of the present disclosure. The embodiment shown in FIG. 4 is applicable to setting tool operations in 5.5 inch diameter or larger casing. In such operations, a Baker 20 setting tool may be appropriate. FIG. 5 is a cross section of an assembled setting tool in a run-in configuration. The embodiment shown in FIG. 5 is applicable to setting tool operations in 4.5 inch diameter casing. In such operations, a Baker 10 setting tool may be appropriate. Thus, the setting tool of FIG. 5 is smaller than the setting tool shown in FIG. 4. Exemplary embodiments may have the nominal dimensions in inches that fall within the ranges shown in FIGS. 2B, 2C, 4, 5 according to the following table. This disclosure also contemplates a value of plus/minus 10% for each of the range endpoint values in the table.

| Dimension | FIG. 4 | FIG. 5 |
|---|---|---|
| Tool length 60 | 26.4 to 30.4 | 25.9 to 27.9 |
| Lower mandrel length 62 | 11.5 to 13.5 | 10.9 to 12.9 |
| Lower mandrel O.D. 64 | 1.5 to 2.5 | 0.8 to 1.8 |
| Barrel Piston O.D. 66 | 3.3 to 4.3 | 2.2 to 3.2 |
| Barrel Piston I.D. 67 | 2.4 to 3.4 | 1.5 to 2.5 |
| Vent port location 68 | 3.0 to 5.0 | 2.4 to 4.4 |
| Barrel piston length 70 | 16.3 to 18.3 | 12.0 to 16.0 |
| Upper mandrel length 72 | 15.0 to 19.0 | 15.5 to 17.5 |

-continued

| Dimension | FIG. 4 | FIG. 5 |
|---|---|---|
| Upper mandrel shoulder stop location 74 | 11.0 to 15.0 | 12.0 to 14.0 |
| Power charge chamber depth 76 | 13.9 to 17.9 | 14.0 to 16.0 |
| Axial discharge port location diameter 78 | 1.8 to 2.8 (FIG. 2B) | 1.0 to 2.0 (FIG. 2C) |
| Axial discharge port diameter 82 | 0.1 to 1.1 (FIG. 2B) | 0.1 to 1.1 (FIG. 2C) |
| Axial discharge port depth 83 | 0.9 to 1.9 (FIG. 2B) | 1.1 to 2.1 (FIG. 2C) |
| Upper mandrel O.D. 84 | 2.2 to 3.2 | 1.5 to 2.5 |
| Upper mandrel I.D. 86 | 1.3 to 2.3 | 0.7 to 1.7 |
| Upper power charge chamber diameter 88 | 0.7 to 1.7 | 0.6 to 1.6 |
| Lower power charge chamber maximum diameter 90 | 1.8 to 2.8 | 0.9 to 1.9 |
| Upper to lower power charge chamber transition location 92 | 11.2 to 15.2 | 12.9 to 14.9 |
| Vent port travel 94 | 4.6 to 8.6 | 3.1 to 7.1 |

Figure 6:
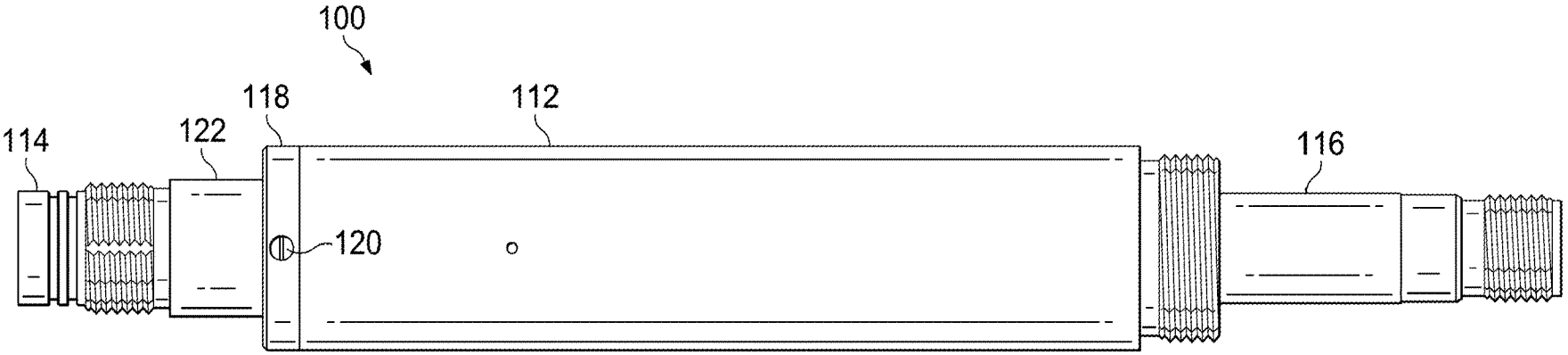
FIG. 6 is an elevation view of an alternate embodiment of a setting tool according to the teachings of the present disclosure.

FIG. 6 is an elevation view of an alternate embodiment of a setting tool 100 according to the teachings of the present disclosure. The setting tool 100 is the same as the setting tool shown and described above with respect to FIGS. 1A thru 4 with the exception of a length of the upper mandrel 114. The setting tool 100 may be employed in situations in which a Baker 20 setting tool might otherwise be used. The setting tool 100 includes a barrel piston 112, an upper mandrel 114, and a lower mandrel 116. A retainer cap 118 allows the barrel piston 112 to be coupled to the upper mandrel 114 using a shear screw 120. The upper mandrel 114 has an increased length such that a portion 122 extends beyond the retainer cap 118. This portion 122 provides a tool receiving surface to allow a tool, for example a wrench, to be applied to the portion 122 to prevent rotation of the setting tool 100 when the firing head is threaded onto the setting tool 100. According to one embodiment the tool receiving portion 122 may have an axial length in a range of one to three inches. In one embodiment, the axial length of the tool receiving portion 122 is about 1.75 inches. According to certain embodiments, the tool receiving portion 122 may be knurled on its outer surface to indicate that it is safe to apply a tool to this surface. Such an extended upper mandrel 114 may be particularly useful in the event a frac plug or other downhole isolation device is attached to the lower mandrel 116 before the firing head is attached to the setting tool 100. With the frac plug attached, the lower mandrel 116 is not available in order to apply a tool, such as a wrench to keep the setting tool 100 from unintentionally rotating. The setting tool 100 may include dimensions in the range shown in the chart above and illustrated with respect to FIG. 4.

Figure 7:
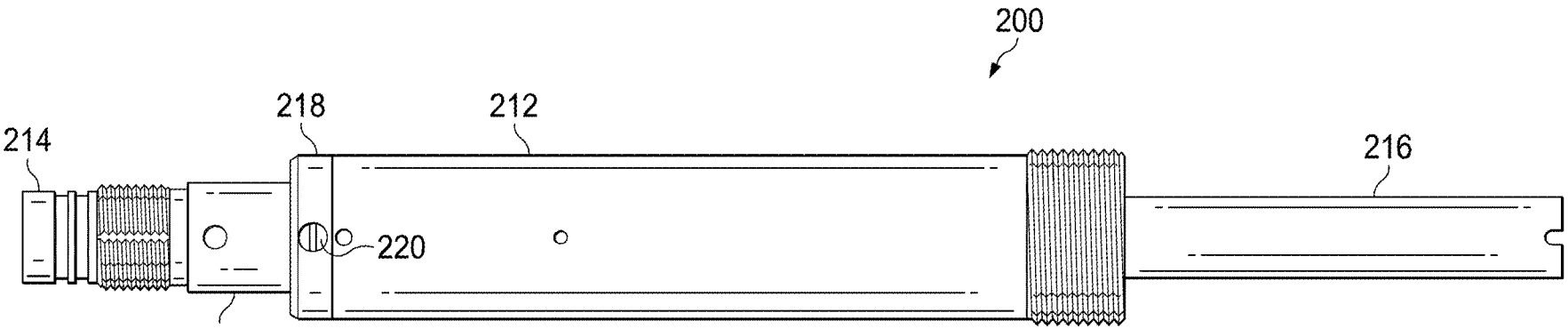
FIG. 7 is an elevation view of yet another embodiment of a setting tool according to the teachings of the present disclosure.

FIG. 7 is an elevation view of an alternate embodiment of a setting tool 200 according to the teachings of the present disclosure. The setting tool 200 is the same as the setting tool shown and described above with respect to FIGS. 1A thru 5 with the exception of an axial length of the barrel piston 212. The setting tool 200 may be employed in situations in which a Baker 10 setting tool might otherwise be used. The setting tool 200 includes the barrel piston 212, an upper mandrel 214, and a lower mandrel 216. A retainer cap 218 allows the barrel piston 212 to be coupled to the upper mandrel 214 using a shear screw 220. The barrel piston 112 has a reduced axial length such that a portion 222 of the upper mandrel 214 extends beyond the retainer cap 218. This portion 222 provides a tool receiving surface to allow a tool, for example a wrench, to be applied to the portion 222 to prevent rotation of the setting tool 200 when the firing head is threaded onto the setting tool 200. According to one embodiment the tool receiving portion 222 may have an axial length in a range of one to three inches. In one embodiment, the axial length of the tool receiving portion 222 is about 1.75 inches. According to certain embodiments, the tool receiving portion 222 may be knurled on its outer surface to indicate that it is safe to apply a tool to this surface. Such a shortened barrel piston 212 may be particularly useful in the event a frac plug or other downhole isolation device is attached to the lower mandrel 216 before the firing head is attached to the setting tool 200. With the frac plug attached, the lower mandrel 216 is not available in order to apply a tool, such as a wrench to keep the setting tool 200 from unintentionally rotating. The setting tool 200 may include dimensions in the range shown in the chart above and illustrated with respect to FIG. 5.

As utilized herein with respect to numerical ranges, the terms "approximately," "about," "substantially," and similar terms generally mean+/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

It is important to note that the construction and arrangement of the setting tool as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A setting tool, comprising:

a barrel piston configured to couple to a setting sleeve, the barrel piston defining a working surface and a vent port, the barrel piston further defining an inner cylindrical surface and a longitudinal axis of the setting tool;

an upper mandrel disposed within the barrel piston and defining a power charge chamber configured to receive a power charge, the upper mandrel comprising an upper threaded portion, a lower internal thread, an outer cylindrical surface separated from the inner cylindrical surface of the barrel piston by an annular clearance region, a shoulder stop extending radially from the outer cylindrical surface, and a plurality of axial discharge ports disposed circumferentially around the lower internal thread, the plurality of axial discharge ports being in fluid communication at one end with the power charge chamber and at the other end with the working surface of the barrel piston, each one of the plurality of axial discharge ports defining a discharge port axis parallel with the longitudinal axis of the setting tool; and a lower mandrel having an upper end and a lower end, the upper end in threaded engagement with the lower internal thread of the upper mandrel, the lower end configured to couple to a frac plug;

wherein the power charge chamber comprises an upper chamber and a lower chamber, the lower chamber having a frustoconical shape intersecting with each of the plurality of axial discharge ports; and wherein the barrel piston is configured for axial displacement with respect to the upper mandrel.

2. The setting tool of claim 1 wherein the upper chamber is generally cylindrical with a generally constant diameter.

3. The setting tool of claim 1 further comprising a power charge disposed in the power charge chamber.

4. The setting tool of claim 1 wherein the plurality of axial discharge ports are circumferentially spaced apart evenly.

5. The setting tool of claim 4 wherein the plurality of axial discharge ports comprises at least four axial discharge ports.

6. The setting tool of claim 5 wherein the plurality of axial discharge ports comprises six axial discharge ports.

7. The setting tool of claim 6 wherein the plurality of axial discharge ports comprises at least ten axial discharge ports.

8. The setting tool of claim 1 wherein the working surface of the barrel piston is disposed orthogonally to the discharge port axes of the plurality of discharge ports.

9. The setting tool of claim 1 further comprising a retainer cap threaded to the barrel piston and wherein the upper mandrel includes a tool receiving surface proximate the retainer cap.

10. The setting tool of claim 1 wherein each one of the plurality of the axial discharge ports is semi-blind.

11. The setting tool of claim 1 further comprising a retainer cap coupled to the barrel piston, the retainer cap configured to contact the shoulder stop when the barrel piston is stroked.

12. A mandrel of a setting tool, comprising:

a body defining a power charge chamber comprising an upper chamber and a lower chamber, the power charge chamber being configured to receive a power charge, the body further comprising an upper threaded portion, a lower internal thread, and a plurality of axial discharge ports disposed circumferentially around the lower internal thread, the plurality of axial discharge ports being in fluid communication with the power charge chamber, the body defining a longitudinal mandrel axis and further comprising a shoulder stop extending radially from an outer cylindrical surface of the body, each of the axial discharge ports defining a discharge port axis parallel to the longitudinal mandrel axis; and wherein the lower chamber is frustoconically shaped and intersects with each of the plurality of axial discharge ports.

13. The mandrel of claim 12 wherein the upper chamber is generally cylindrical with a generally constant diameter.

14. The mandrel of claim 12 wherein the plurality of axial discharge ports are circumferentially spaced apart evenly.

15. The mandrel of claim 14 wherein the plurality of axial discharge ports comprises at least six axial discharge ports.

16. The mandrel of claim 12 further comprising a barrel piston defining a working surface, the plurality of axial discharge ports being in fluid communication with the working surface.

17. The mandrel of claim 12 wherein each of the plurality of axial discharge ports is semi-blind.

18. A mandrel of a setting tool, comprising:

a body defining a power charge chamber comprising an upper chamber and a lower chamber, the power charge chamber being configured to receive a power charge, the body defining a longitudinal mandrel axis and further comprising an upper threaded portion, a lower internal thread, and a plurality of axial discharge ports disposed circumferentially around the lower internal thread, the plurality of axial discharge ports being in fluid communication with the power charge chamber, the body including a shoulder stop extending from an external cylindrical surface, each of the plurality of axial discharge ports defining a discharge port axis parallel to the longitudinal mandrel axis; and wherein the lower chamber is frustoconically shaped and intersects with each of the plurality of axial discharge ports and each of the plurality of axial discharge ports is semi-blind.

19. The mandrel of claim 18 wherein the upper chamber is generally cylindrical with a generally constant diameter.

* * * * *